US006782777B1

(12) United States Patent
Wei

(10) Patent No.: US 6,782,777 B1
(45) Date of Patent: Aug. 31, 2004

(54) SOCKET CONNECTOR STRUCTURE

(76) Inventor: Chiao Wei, No. 1, Alley 16, Lane 40, Jinn Te Rd., Taichung (TW)

( * ) Notice: Subject to any disclaimer, the term of this patent is extended or adjusted under 35 U.S.C. 154(b) by 46 days.

(21) Appl. No.: 10/189,817

(22) Filed: Jul. 2, 2002

(51) Int. Cl.[7] ..... B25B 23/16
(52) U.S. Cl. ..... 81/177.85; 81/60
(58) Field of Search ..... 81/60, 61, 177.85

(56) References Cited

U.S. PATENT DOCUMENTS 2,803,980 A * 8/1957 Vogel ..... 81/60
5,761,973 A * 6/1998 Tung ..... 81/177.85
6,006,631 A * 12/1999 Miner et al. ..... 81/177.85
6,067,881 A * 5/2000 Albertson ..... 81/60
2003/0126957 A1 * 7/2003 Huang ..... 81/60

* cited by examiner

*Primary Examiner*—James G. Smith
(74) *Attorney, Agent, or Firm*—Eric Karich

(57) ABSTRACT

A socket connector structure includes a base formed with two drive heads. The two drive heads formed with two circular holes and two ball receiving holes. Two drive rods are each slidably mounted in the circular hole, and are each formed with a bidirectional ball receiving cavity aligning with the ball receiving hole. Two elastic members are each mounted in the circular hole, and are each biased between the drive rod and the wall of the circular hole. Two balls are each received in the ball receiving hole, and locked in a space formed by the ball receiving hole of the drive head and the bi-directional ball receiving cavity of the drive rod.

8 Claims, 15 Drawing Sheets

SOCKET CONNECTOR STRUCTURE

BACKGROUND OF THE INVENTION

1. Field of the Invention

The present invention relates to a socket connector structure, and more particularly to a socket connector structure having two drive heads that may be detached from the socket easily and quickly.

2. Description of the Related Art

The closest prior art of which the applicant is aware is disclosed in U.S. Pat. No. 5,904,077, which teaches a hand tool having two drive heads. When the drive head of the hand tool is to be detached from the socket, the user's finger has to extend into the socket to press the drive rod in the drive head so that the ball may retract into the ball receiving cavity of the drive rod, thereby detaching the drive head from the socket. Thus, the hand tool can only mate with a socket having a larger size.

SUMMARY OF THE INVENTION

The present invention has arisen to mitigate and/or obviate the disadvantage of the conventional hand tool.

The primary objective of the present invention is to provide a socket connector structure having two drive heads that may be detached from the socket easily and quickly.

In accordance with a first aspect of the present invention, there is provided a socket connector structure, comprising:

a base having two ends formed with two drive heads protrude outward therefrom, the two drive heads axially formed with two circular holes communicating with each other, and a ball receiving hole transversely formed in each of the two drive heads;

two drive rods abutting each other and each slidably mounted in the circular hole of each of the two drive heads, each of the two drive rods formed with a bidirectional ball receiving cavity aligning with the ball receiving hole;

two elastic members each mounted in the circular hole of each of the two drive heads, and each biased between the drive rod and a wall of the circular hole; and two balls each received in the ball receiving hole of each of the two drive heads, and locked in a space formed by the ball receiving hole of the drive head and the bi-directional ball receiving cavity of the drive rod.

In accordance with a second aspect of the present invention, there is provided a socket connector structure, comprising:

a base having two ends provided with two drive heads protruded outward therefrom, the two drive heads axially formed with two circular holes communicating with each other, and a ball receiving hole transversely formed in each of the two drive heads;

a drive rod slidably mounted in the circular hole of each of the two drive heads, the drive rod having two ends each formed with a bi-directional ball receiving cavity aligning with the ball receiving hole, and the drive rod having a mediate portion formed with an annular flange;

two elastic members each mounted in the circular hole of each of the two drive heads, and each biased between the annular flange of the drive rod and a wall of the circular hole; and two balls each received in the ball receiving hole of each of the two drive heads, and locked in a space formed by the ball receiving hole of the drive head and the bi-directional ball receiving cavity of the drive rod.

Further benefits and advantages of the present invention will become apparent after a careful reading of the detailed description with appropriate reference to the accompanying drawings.

DETAILED DESCRIPTION OF THE INVENTION

Figure 1:
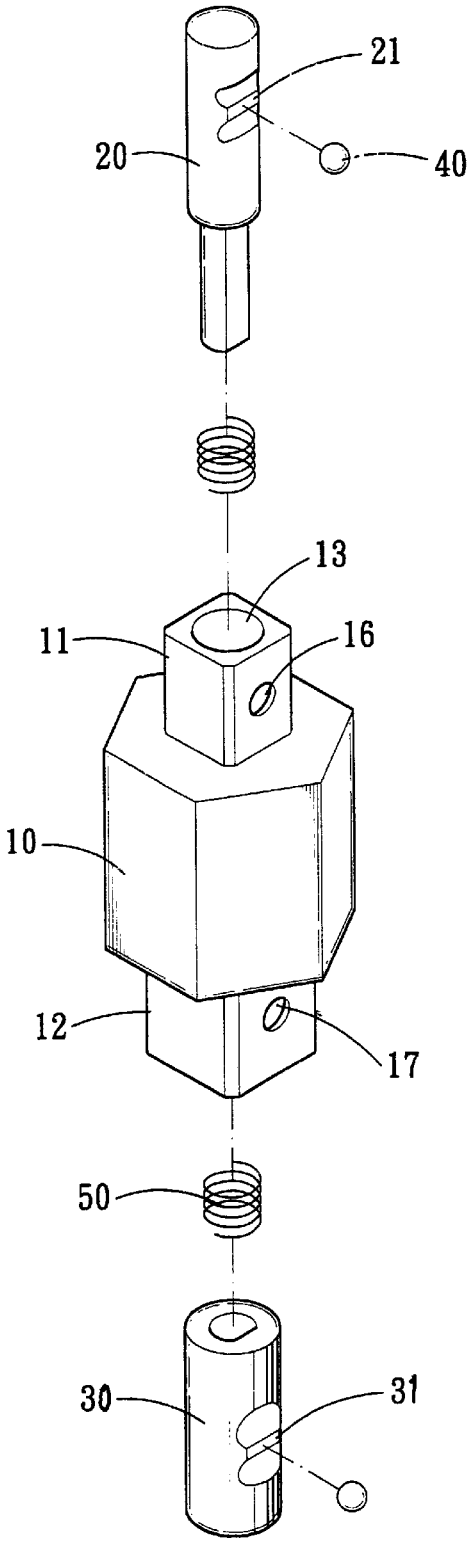
FIG. 1 is an exploded perspective view of a socket connector structure in accordance with a first embodiment of the present invention.
Figure 2:
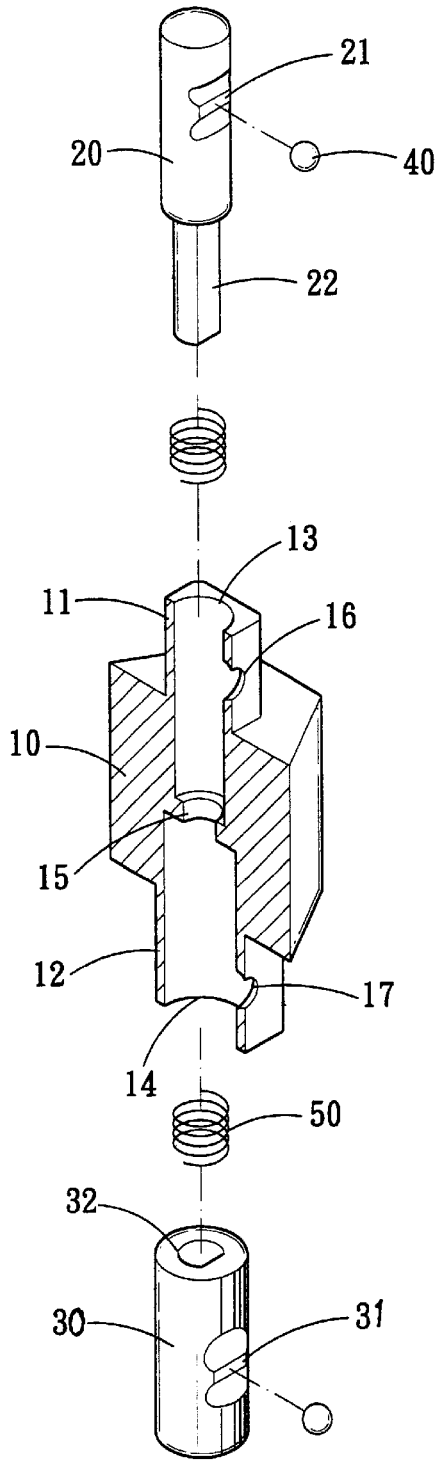
FIG. 2 is a partially cross-sectional exploded perspective view of a socket connector structure in accordance with a first embodiment of the present invention.
Figure 3:
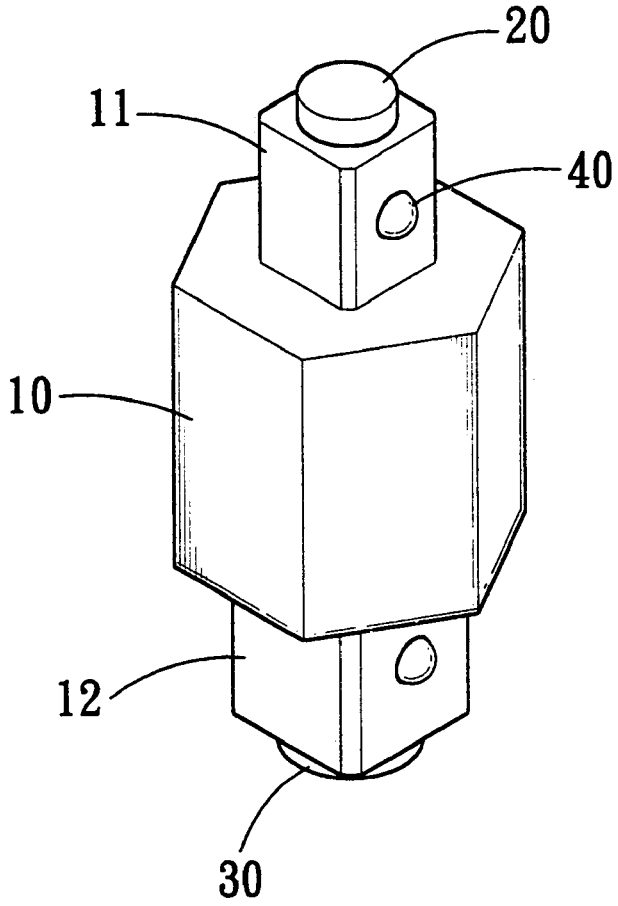
FIG. 3 is a perspective assembly view of the socket connector structure as shown in FIG. 1.

Referring to the drawings and initially to FIGS. 1–6, a dual-directional socket connector structure in accordance with a first embodiment of the present invention comprises a base 10, and two drive rods 20 and 30.

The base 10 has a first end formed with a drive head 11 protruded outward therefrom. A circular hole 13 is axially formed in the drive head 11, and a ball receiving hole 16 is transversely formed in the drive head 11. The base 10 has a second end formed with a drive head 12 protruded outward therefrom. A circular hole 14 is axially formed in the drive head 12, and a ball receiving hole 17 is transversely formed in the drive head 12. A connecting hole 15 is formed in the base 10, and is communicated with the circular holes 13 and 14. The connecting hole 15 has a diameter smaller than that of the circular hole 13 and 14.

The drive rod 20 is slidably mounted in the circular hole 13, and is formed with a bi-directional ball receiving cavity 21, and a push bar 22. The bi-directional ball receiving cavity 21 aligns with the ball receiving hole 16. A ball 40 is received in the ball receiving hole 16, and is locked in a space formed by the ball receiving hole 16 of the drive head 11 and the bi-directional ball receiving cavity 21 of the drive rod 20.

The drive rod 30 is slidably mounted in the circular hole 14, and is formed with a bi-directional ball receiving cavity 31, and a push hole 32. The bi-directional ball receiving cavity 31 aligns with the ball receiving hole 17. A ball 40 is received in the ball receiving hole 17, and is locked in a space formed by the ball receiving hole 17 of the drive head 12 and the bidirectional ball receiving cavity 31 of the drive rod 30.

The push bar 22 of the drive rod 20Lis in turn extended through an elastic member 50 received in the circular hole 13, the connecting hole 15, an elastic member 50 received in the circular hole 14, and is inserted into the push hole 32 of the drive rod 30.

Figure 4:
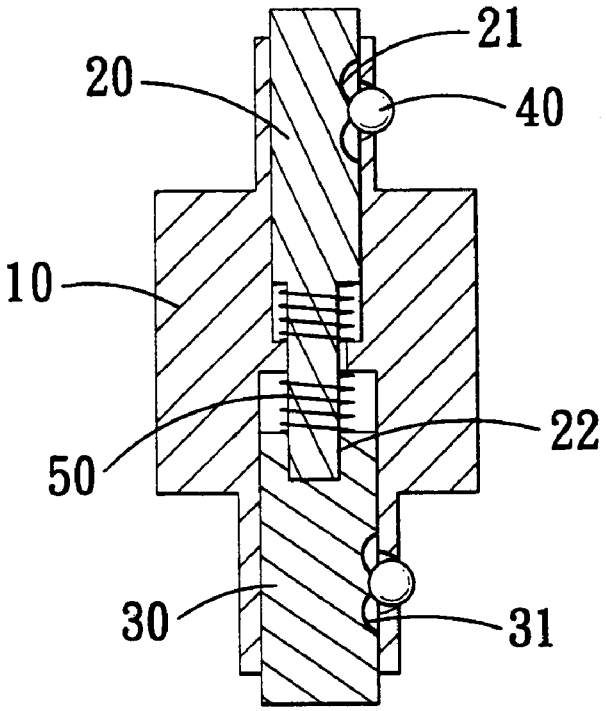
FIG. 4 is a front plan cross-sectional view of the socket connector structure as shown in FIG. 3.
Figure 5:
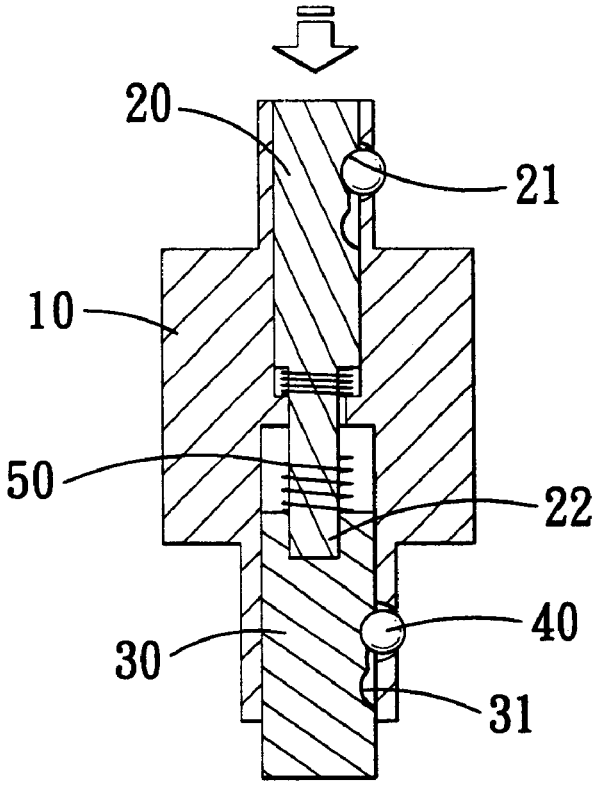
FIG. 5 is a schematic operational view of the socket connector structure as shown in FIG. 4 in use.

In operation, referring to FIGS. 4 and 5, if the drive head 12 is fitted into a socket (not shown), the drive rod 20 may be pressed to compress the elastic member 50 and to move the drive rod 30, thereby aligning the upper end of the bidirectional ball receiving cavity 31 of the drive rod 30 with the ball receiving hole 17 of the drive head 12, so that the ball 40 may be retracted into the upper end of the bi-directional ball receiving cavity 31 of the drive rod 30. Thus, the drive head 12 may be detached from the socket easily and quickly, without having to apply a large force for detaching the drive head 12 from the socket. The drive rod 20 may then be released, and may be returned to its original position as shown in FIG. 4 by the restoring force of the elastic member 50.

Figure 6:
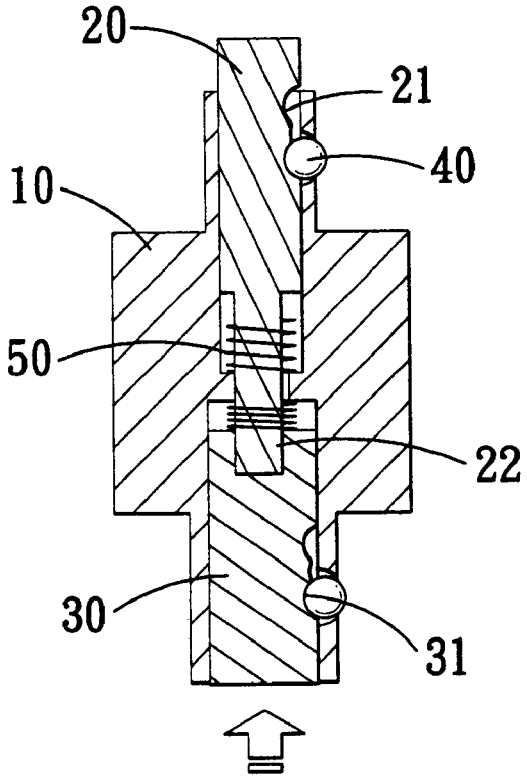
FIG. 6 is a schematic operational view of the socket connector structure as shown in FIG. 4 in use.

Alternatively, referring to FIGS. 4 and 6, if the drive head 11 is fitted into a socket (not shown), the drive rod 30 may be pressed to compress the elastic member 50 and to move the drive rod 20, thereby aligning the lower end of the bi-directional ball receiving cavity 21 of the drive rod 20 with the ball receiving hole 16 of the drive head 11, so that the ball 40 may be retracted into the lower end of the bi-directional ball receiving cavity 21 of the drive rod 20. Thus, the drive head 11 may be detached from the socket easily and quickly, without having to apply a large force for detaching the drive head 11 from the socket. The drive rod 30 may then be released, and may be returned to its original position as shown in FIG. 4 by the restoring force of the elastic member 50.

The drive heads 11 and 12 may have different sizes, so that the dual-directional socket connector structure in accordance with the present invention may be used to fit sockets of two different sizes.

Figure 7:
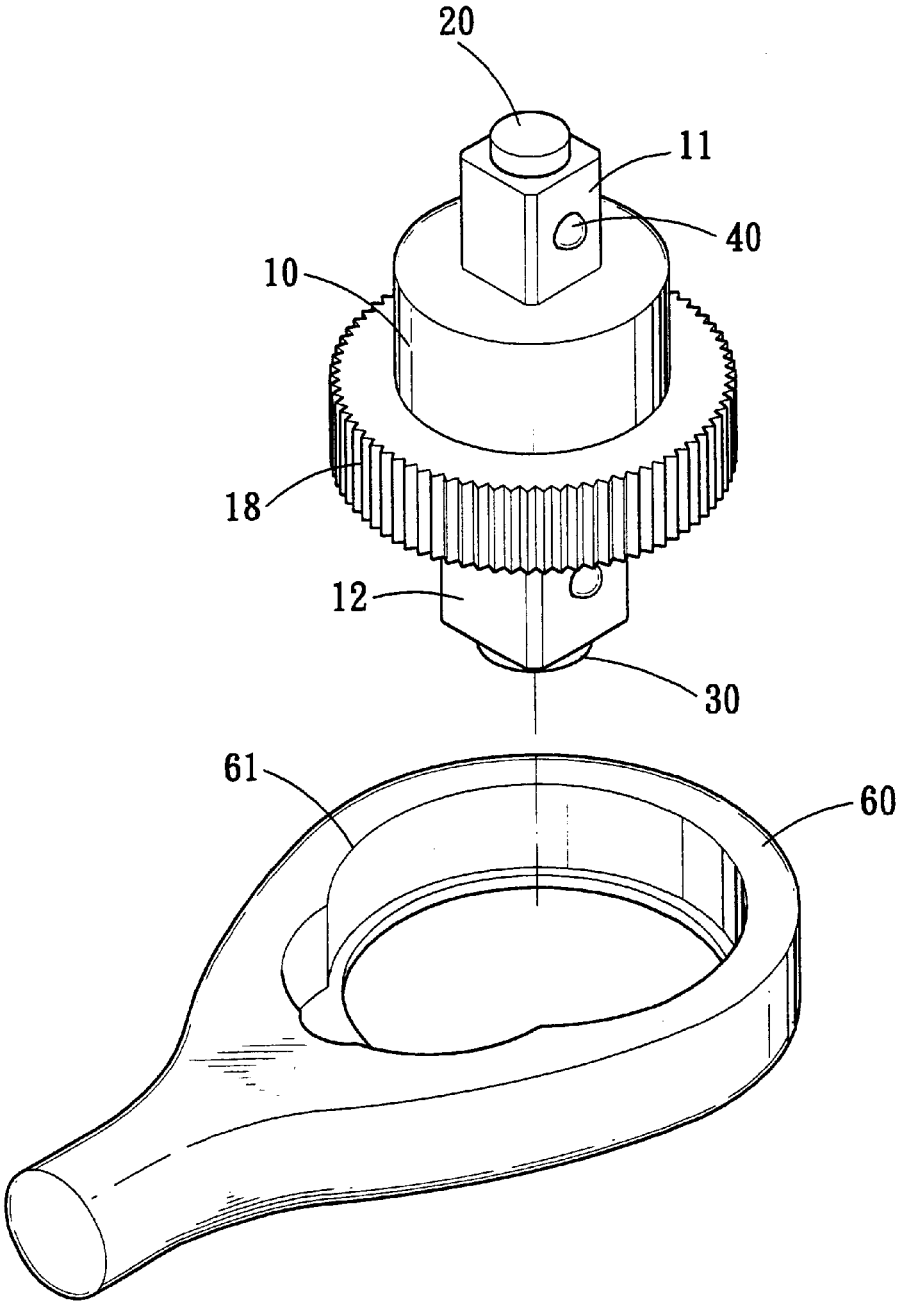
FIG. 7 is an exploded perspective view of a socket connector structure for a ratchet wrench in accordance with the first embodiment of the present invention.

Referring to FIG. 7, the dual-directional socket connector structure in accordance with the present invention may co-operate with a ratchet wrench 60. The base 10 of the dual-directional socket connector structure has an outer periphery formed with annular teeth 18 received in the receiving recess 61 of the ratchet wrench 60 and engaged with the reversible structure of the ratchet wrench 60.

Figure 8:
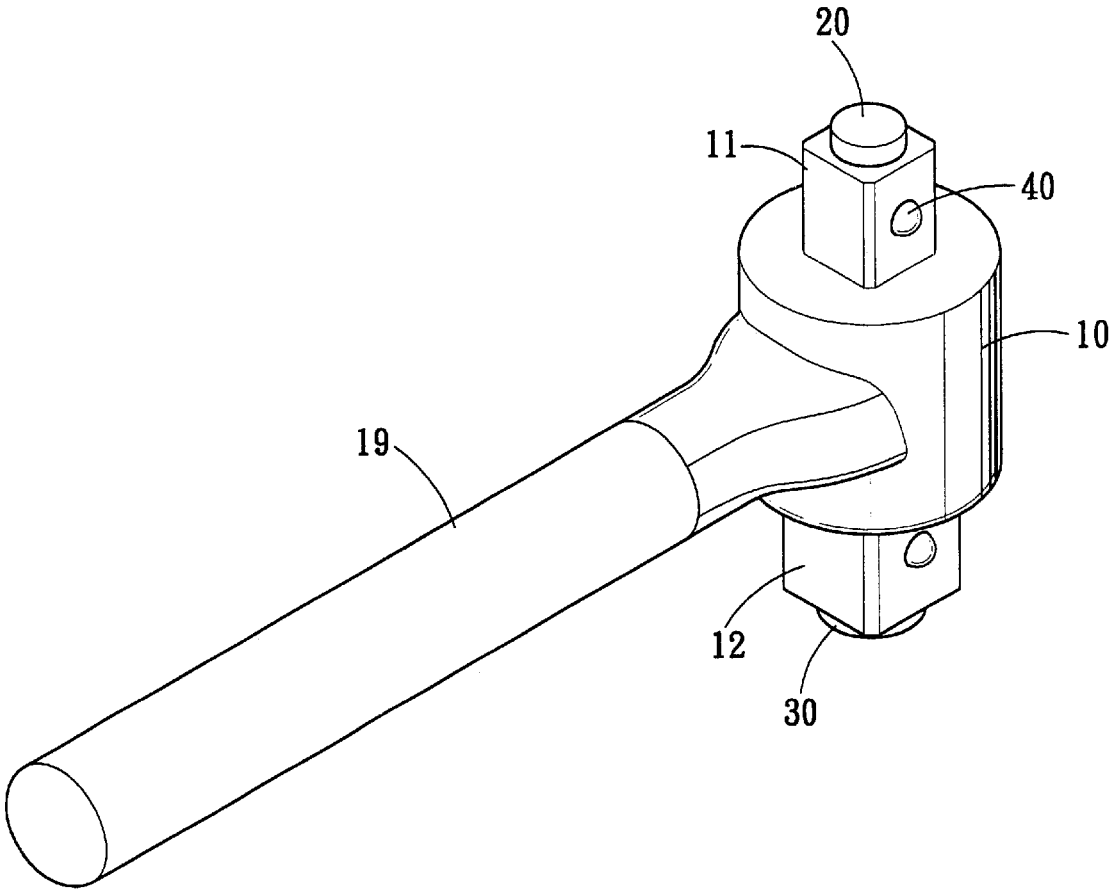
FIG. 8 is a perspective view of a socket connector structure for a drive rod in accordance with the first embodiment of the present invention.

Referring to FIG. 8, the base 10 of the dual-directional socket connector structure in accordance with the present invention has one side provided with an elongated drive rod 19 for driving and rotating a socket in an energy saving manner.

Figure 9:
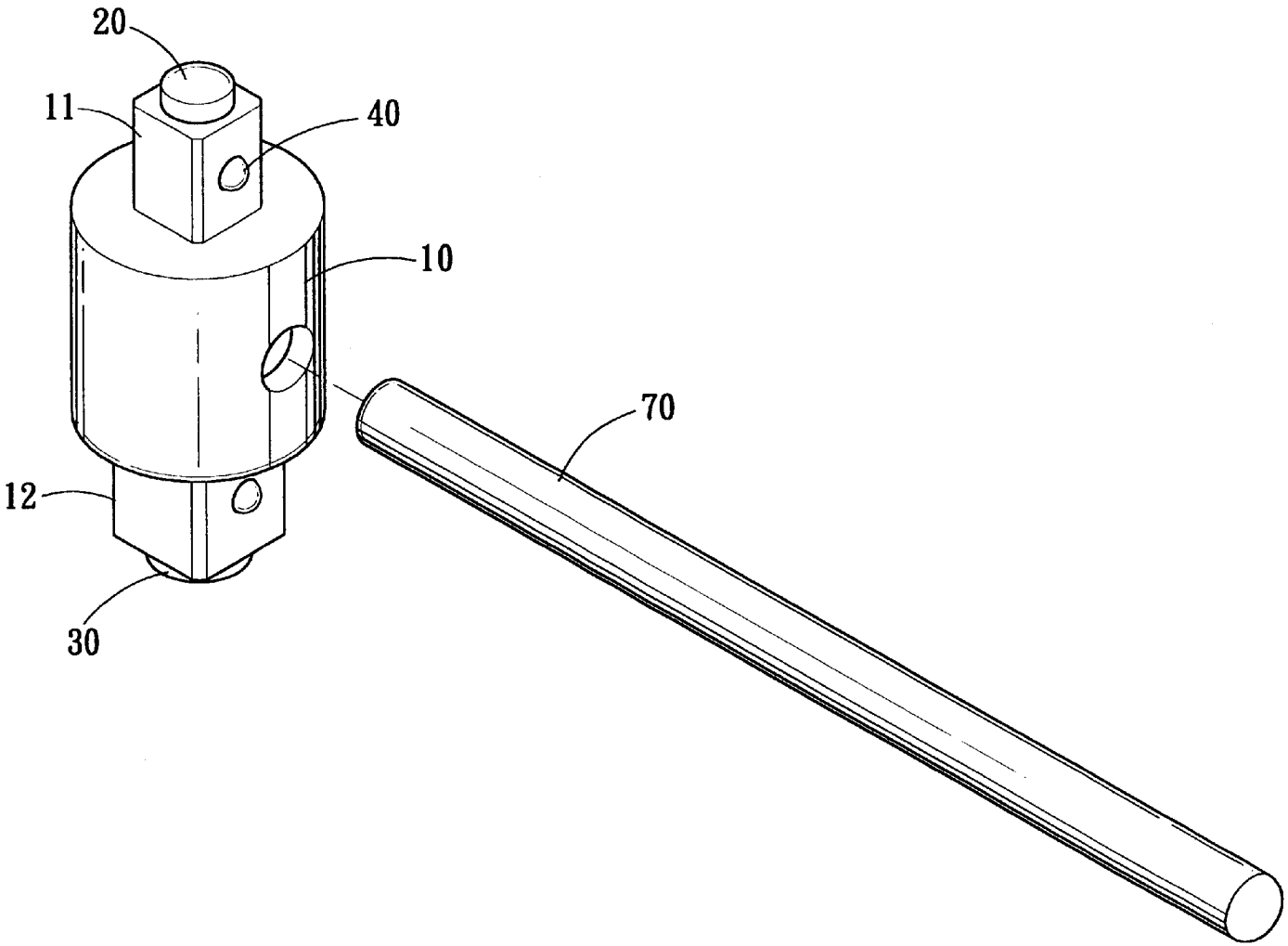
FIG. 9 is a perspective view of a socket connector structure for an elongated rod in accordance with the first embodiment of the present invention.

Referring to FIG. 9, the base 10 of the dual-directional socket connector structure in accordance with the present invention has one side formed with a hole for insertion of an elongated drive rod 70 for driving and rotating a socket in an energy saving manner.

Figure 10:
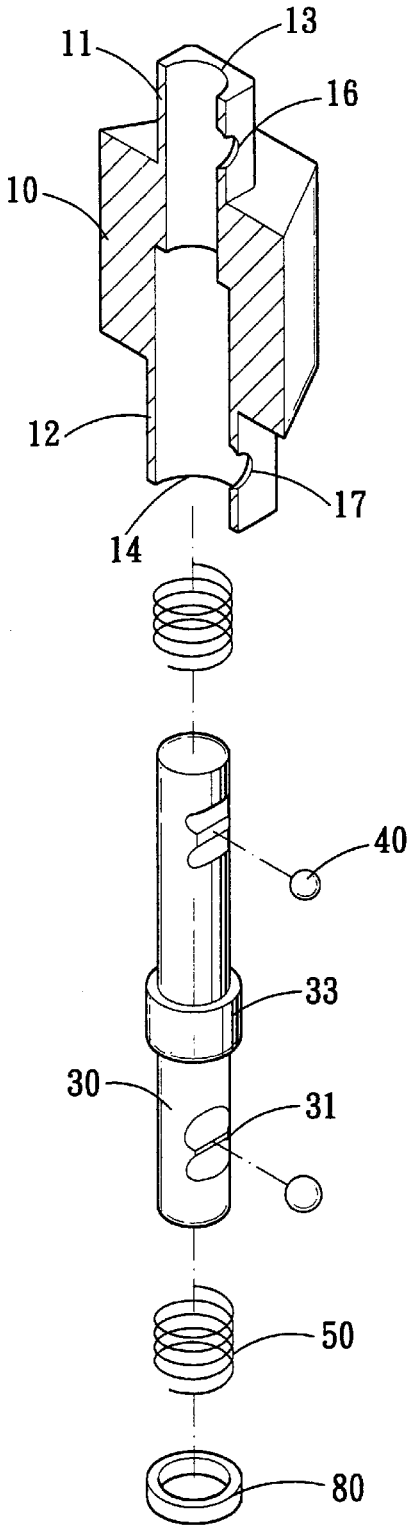
FIG. 10 is an exploded perspective view of a socket connector structure in accordance with a second embodiment of the present invention.
Figure 11:
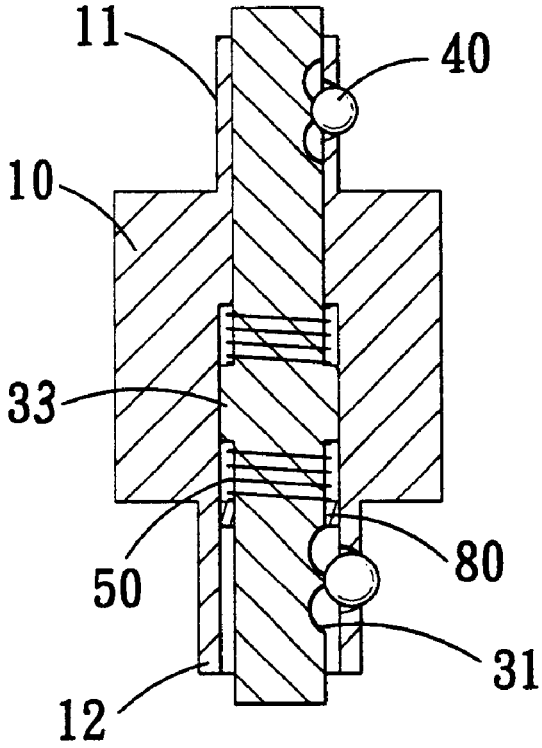
FIG. 11 is a front plan cross-sectional assembly view of the socket connector structure as shown in FIG. 10.
Figure 12:
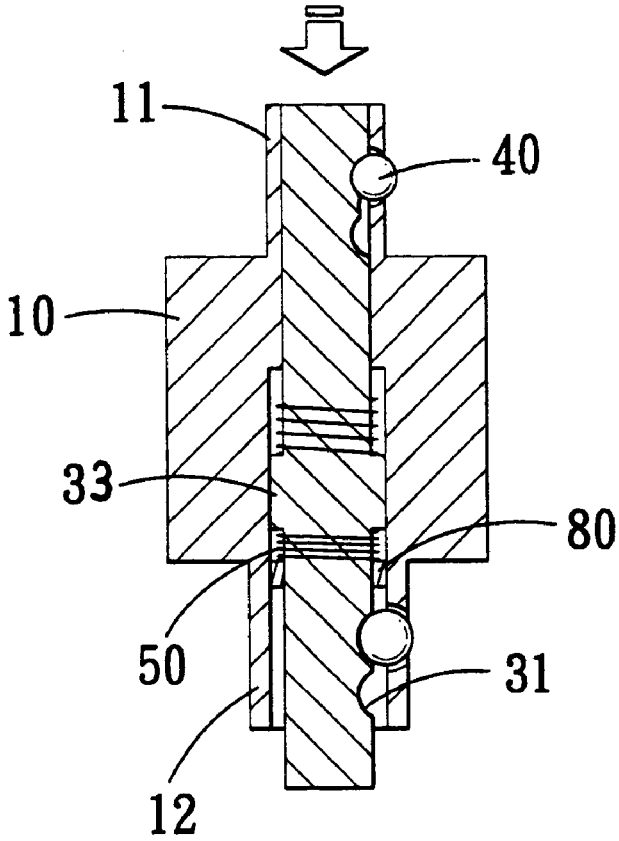
FIG. 12 is a schematic operational view of the socket connector structure as shown in FIG. 11 in use.

Referring to FIGS. 10–12, the dual-directional socket connector structure in accordance with a second embodiment of the present invention only comprises a drive rod 30 which is formed by integrally combining the original two drive rods 20 and 30. The drive rod 30 has two ends each formed with a bi-directional ball receiving cavity 31, and a mediate portion formed with an annular flange 33 on which the two elastic members 50 are rested. The connecting hole 15 is undefined. A washer 80 is mounted on one end of the drive rod 30, thereby preventing the drive rod 30 vibrating in the circular hole 14 of the drive head 12.

In operation, referring to FIGS. 11 and 12 with reference to FIG. 10, the drive rod 30 may be pressed to compress the elastic member 50 and to move in the circular holes 13 and 14, thereby aligning the upper end of the bi-directional ball receiving cavity 31 of the drive rod 30 with the ball receiving hole 16 and 17 of the drive head 11 and 12, so that the ball 40 may be retracted into the upper end of the bi-directional ball receiving cavity 31 of the drive rod 30. Thus, the drive head 12 may be detached from the socket easily and quickly, without having to apply a large force for detaching the drive head 12 from the socket. The drive rod 30 may then be released, and may be returned to its original position as shown in FIG. 11 by the restoring force of the elastic member 50.

Figure 13:
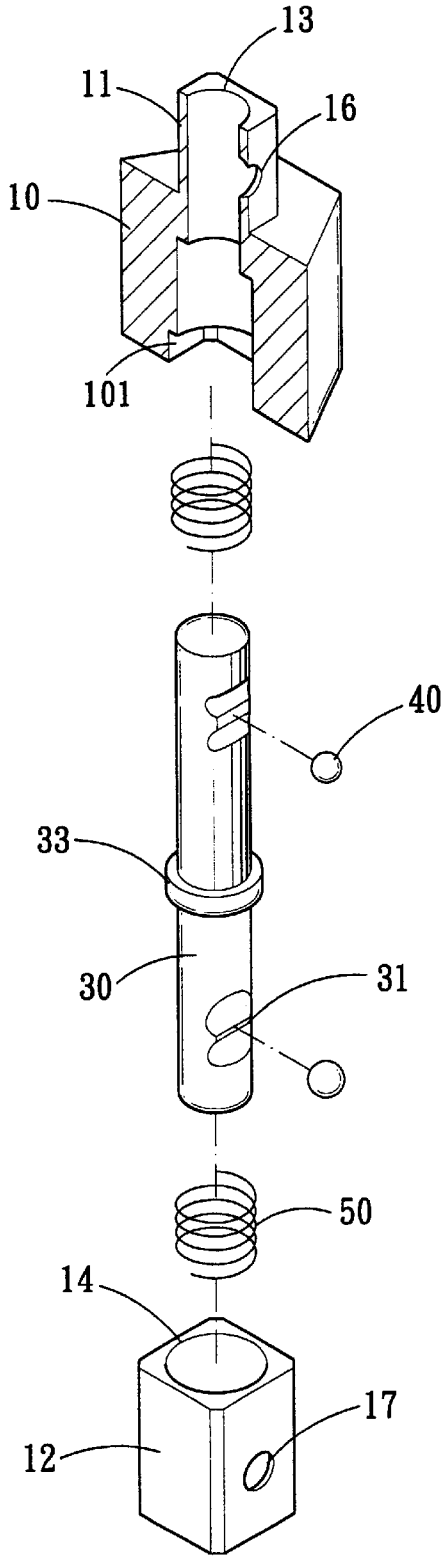
FIG. 13 is an exploded perspective view of a socket connector structure in accordance with a third embodiment of the present invention.
Figure 14:
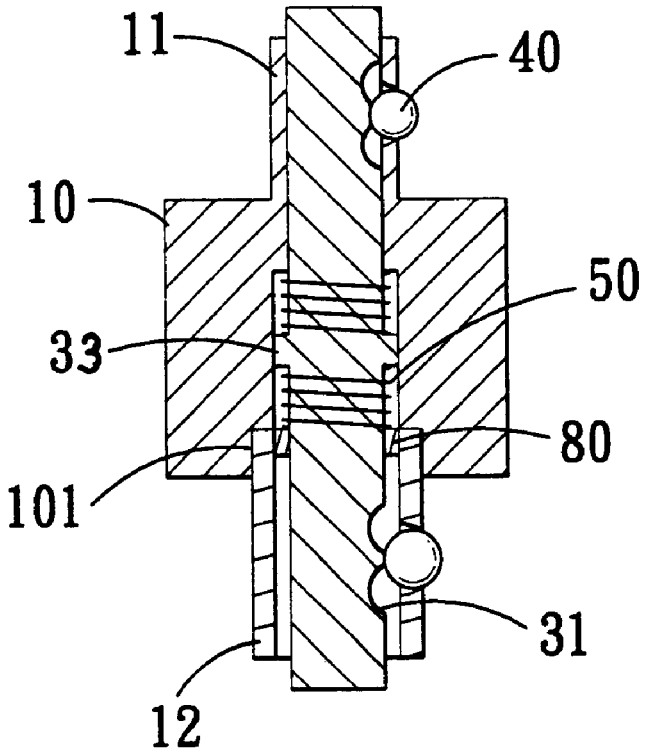
FIG. 14 is a front plan cross-sectional assembly view of the socket connector structure as shown in FIG. 13.
Figure 15:
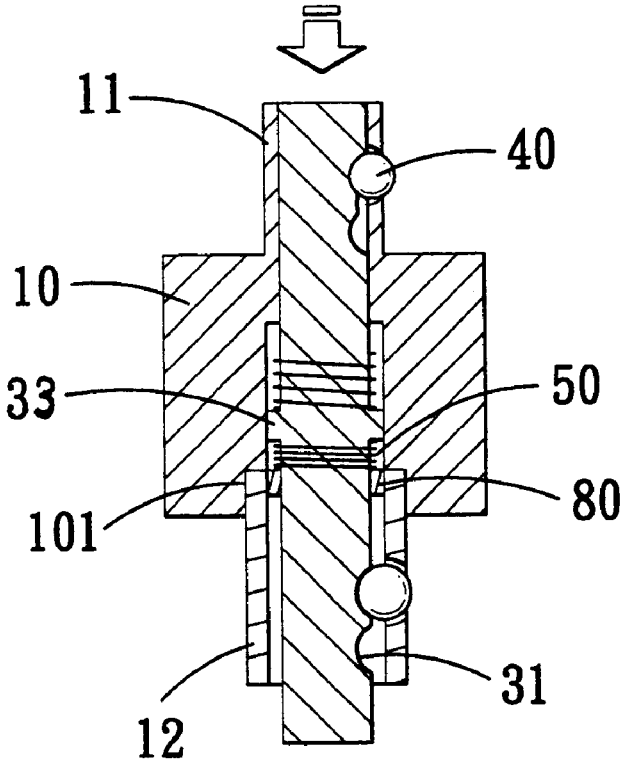
FIG. 15 is a schematic operational view of the socket connector structure as shown in FIG. 14 in use.

Referring to FIGS. 13–15, the dual-directional socket connector structure in accordance with a third embodiment of the present invention only comprises a drive rod 30 which is formed by integrally combining the original two drive rods 20 and 30. The drive rod 30 has two ends each formed with a bi-directional ball receiving cavity 31, and a mediate portion formed with an annular flange 33 on which the two elastic members 50 are rested. The connecting hole 15 is undefined. The drive head 12 is separated from the base 10, and is secured in a square seat 101 formed in the base 10. A washer 80 is mounted on one end of the drive rod 30, thereby preventing the drive rod 30 vibrating in the circular hole 14 of the drive head 12.

In operation, referring to FIGS. 14 and 15 with reference to FIG. 13, the drive rod 30 may be pressed to compress the elastic member 50 and to move in the circular holes 13 and 14, thereby aligning the upper end of the bi-directional ball receiving cavity 31 of the drive rod 30 with the ball receiving hole 16 and 17 of the drive head 11 and 12, so that the ball 40 may be retracted into the upper end of the bi-directional ball receiving cavity 31 of the drive rod 30. Thus, the drive head 12 may be detached from the socket easily and quickly, without having to apply a large force for detaching the drive head 12 from the socket. The drive rod 30 may then be released, and may be returned to its original position as shown in FIG. 14 by the restoring force of the elastic member 50.

Accordingly, in the dual-directional socket connector structure in accordance with the present invention, when the first drive head is fitted into a socket, the drive rod of the second drive head may be pressed, so as to detach the first drive head from the socket easily and quickly, so that the dual-directional socket connector structure of the present invention may be used to fit sockets of two different sizes.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket connector structure, comprising:

a base having two ends formed with two drive heads protruded outward therefrom, the two drive heads axially formed with two circular holes communicating with each other, and a ball receiving hole transversely formed in each of the two drive heads;

the base being formed with a connecting hole communicated with the circular hole of each the two drive heads, the connecting hole having a diameter smaller than that of the circular hole of each the two drive heads;

two drive rods abutting each other and each slidably mounted in the circular hole of each of the two drive heads, each of the two drive rods formed with a bi-directional ball receiving cavity aligning with the ball receiving hole;

two elastic members each mounted in the circular hole of each of the two drive heads, and each biased between the drive rod and a wall of the circular hole; and two balls each received in the ball receiving hole of each of the two drive heads, and locked in a space formed by the ball receiving hole of the drive head and the bi-directional ball receiving cavity of the drive rod.

2. The socket connector structure in accordance with claim 1, wherein a first one of the two drive rods is formed with a push bar, and a second one of the two drive rods is formed with a push hole for insertion of the push bar.

3. The socket connector structure in accordance with claim 1, wherein the two drive heads have different sizes.

4. The socket connector structure in accordance with claim 1, wherein the base has an outer periphery formed with annular teeth received in a receiving recess of a ratchet wrench.

5. The socket connector structure in accordance with claim 1, wherein the base has one side provided with an elongated drive rod.

6. The socket connector structure in accordance with claim 1, wherein the base has one side formed with a hole for insertion of an elongated drive rod.

7. A socket connector structure, comprising:

a base having two ends provided with two drive heads protruded outward therefrom, the two drive heads axially formed with two circular holes communicating with each other, and a ball receiving hole transversely formed in each of the two drive heads;

a drive rod slidably mounted in the circular hole of each of the two drive heads, the drive rod having two ends each formed with a bi-directional ball receiving cavity aligning with the ball receiving hole, and the drive rod having a mediate portion formed with an annular flange;

a washer mounted on one end of the drive rod, thereby preventing the drive rod from vibrating in the circular hole of each of the drive heads;

two elastic members each mounted in the circular hole of each of the two drive heads, and each biased between the annular flange of the drive rod and a wall of the circular hole; and two balls each received in the ball receiving hole of each of the two drive heads, and locked in a space formed by the ball receiving hole of the drive head and the bi-directional ball receiving cavity of the drive rod.

8. The socket connector structure in accordance with claim 7, wherein one of the two drive heads is separated from the base, and is secured in a square seat formed in the base.

* * * * *